US006225766B1

(12) United States Patent
Ono et al.

(10) Patent No.: US 6,225,766 B1
(45) Date of Patent: May 1, 2001

(54) COLOR CATHODE RAY TUBE

(75) Inventors: Osamu Ono, Fukaya; Shigeru Sugawara, Kodama-gun; Kazunori Satou; Takashi Awano, both of Fukaya, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/359,661

(22) Filed: Jul. 26, 1999

(30) Foreign Application Priority Data

Jul. 27, 1998 (JP) ..... 10-211112

(51) Int. Cl.[7] ..... H01J 29/46; H01J 29/50
(52) U.S. Cl. ..... 315/382; 313/414; 315/15
(58) Field of Search ..... 315/3, 15, 16, 315/14, 382, 382.1; 313/412, 414, 449, 460

(56) References Cited

U.S. PATENT DOCUMENTS 4,935,663 * 6/1990 Shimoma et al. ..... 313/412
5,449,983 9/1995 Sugawara et al. ..... 315/382
5,539,278 * 7/1996 Takahashi ..... 315/14
5,694,004 12/1997 Kimiya et al. ..... 315/15
6,016,030 * 1/2000 Amano et al. ..... 313/414

FOREIGN PATENT DOCUMENTS 64-38947 2/1989 (JP) ..... H01J/29/50

* cited by examiner

*Primary Examiner*—David Vu
*Assistant Examiner*—Hoang Nguyen
(74) *Attorney, Agent, or Firm*—Oblon, Spivak, McClelland, Maier & Neustadt, P.C.

(57) ABSTRACT

An inline type electron gun assembly has a main lens for focusing three electron beams on a phosphor screen. A resistor is arranged in a cathode ray tube. A voltage obtained by dividing a high voltage with the resistor is applied to an intermediate electrode. Voltages of a focusing electrode, the intermediate electrode, and a final accelerating electrode that constitute the main lens are determined to increase sequentially. Electron beam holes in the intermediate electrode on the focusing electrode side, and electron beam holes in the intermediate electrode on the final focusing electrode side form vertically elongated holes longer in the vertical direction than in the horizontal direction. Electron beam holes in the focusing electrode on the intermediate electrode side and electron beam holes in the final accelerating electrode on the intermediate electrode side form open holes having no side wall portions. A color cathode ray tube having an electron gun assembly capable of improving resolving power can be provided.

2 Claims, 4 Drawing Sheets

COLOR CATHODE RAY TUBE

BACKGROUND OF THE INVENTION

The present invention relates to a color cathode ray tube and, more particularly, to a color cathode ray tube of which an electron gun assembly is improved to obtain high resolving power on the entire surface of a phosphor screen.

In a color cathode ray tube, three electron beams emitted from an electron gun assembly are deflected in the horizontal and vertical directions to scan a phosphor screen, thereby displaying an image on the screen. In particular, in a self convergence type inline color cathode ray tube, an inline type electron gun assembly having three electron guns lined up in line on one horizontal plane is incorporated in the neck. As shown in FIG. 1A, a horizontal deflecting magnetic field is formed in a pincushion shape 1H, and as shown in FIG. 1B, a vertical deflecting magnetic field is formed in a barrel shape 1V. Non-uniform magnetic fields are formed as the deflecting magnetic fields in this manner, so that three beams self-converge toward the screen easily without requiring a special unit or the like. Currently, the color cathode ray tube of this type is the main stream.

In this cathode ray tube, since the deflecting magnetic fields described above are non-uniform, even if the beam spot at the central portion of the phosphor screen forms a true circle, the electron beam spots on the peripheral portion of the phosphor screen are under-focused in the horizontal direction as they diverge, and are over-focused in the vertical direction as they converge.

When the amount of deflection of the electron beam increases, the distance from the electron gun assembly to the phosphor screen increases. Even if the beam spot forms a small-diameter true circle at the central portion of the phosphor screen, the beam spots on the peripheral portion of the phosphor screen become over-focused.

As a result, the beam spots on the peripheral portion of the phosphor screen are greatly over-focused in the vertical direction due to the two functions described above, and are substantially focused in the horizontal direction since the two functions described above compensate for each other. More specifically, on the peripheral portion of the phosphor screen, astigmatism is generated by the difference in focused state between the horizontal and vertical directions. As shown in FIG. 2, a beam spot 2 is distorted into a noncircular shape composed of a high-luminance core 3 and a low-luminance halo 4, to considerably degrade the resolving power on the peripheral portion of the phosphor screen.

In order to improve the electron beam diameter, it is important to increase the hole diameters of the electrodes forming the main lens of the electron gun assembly, thereby decreasing spherical aberration. For this purpose, the gap among the three electron beams must be increased. When, however, the gap among the three electron beams is increased, the convergence characteristics of the three electron beams suffer. The hole diameters of the electrodes forming the main lens are limited by the inner diameter of the neck where the electron gun assembly is arranged. More specifically, as described above, to improve the resolving power of the color cathode ray tube, the main lens diameter must be increased without increasing the gap among the three electron beams, and over focus in the vertical direction on the peripheral portion of the screen must be removed.

As a method of achieving an increase in diameter of the main lens and improvement in deflection distortion, Jpn. Pat. Appln. KOKAI Publication No. 64-38947 which corresponds to U.S. Pat. No. 4,897,575 proposes an electron gun assembly having the following structure. In this electron gun assembly, as shown in FIGS. 3A and 3B, the main lens is constituted by a focusing electrode G5, two intermediate electrodes Gm1 and Gm2, and a final accelerating electrode G6. In the electron gun assembly shown in FIGS. 3A and 3B, a high voltage applied to the final accelerating electrode G6 is resistance-divided by a resistor T mounted running along the electrodes of the electron gun assembly to generate first and second predetermined voltages. The first and second predetermined voltages are applied to the intermediate electrodes Gm1 and Gm2. A voltage obtained by superposing a parabolic dynamic voltage, which changes in synchronism with the deflection of the electron beams, to a constant DC voltage is applied to the focusing electrode G5. All the electron beam holes of the focusing electrode G5, intermediate electrodes Gm1 and Gm2, and final accelerating electrode G6 which form the main lens of the electron gun assembly are true-circular holes, and the focusing electrode G5 and final accelerating electrode G6 do not have side wall portions, i.e., peripheral rims, along the surfaces of the electron beam holes. Therefore, an electric field common for the three beams is formed horizontally in the focusing electrode G5 and final accelerating electrode G6. Accordingly, a first quadrupole lens having a relatively strong focusing function in the vertical direction is formed near the focusing lens G5, and a second quadrupole lens having a relatively strong divergent function in the vertical direction is formed near the final accelerating electrode G6.

In the electron gun assembly having the above arrangement, the intermediate electrodes Gm1 and Gm2 can form an extended electric field lens, which is an extension of the main lens. Furthermore, when electron beams are deflected toward the peripheral portion of the screen, since a higher voltage (dynamic voltage) is supplied to the focusing electrode G5 to reduce the voltage difference between the focusing electrode G5 and the adjacent intermediate electrode Gm1, the function of the first quadrupole lens is weakened. The electron beams therefore diverge in the vertical direction to compensate for over-focusing in the vertical direction effected by the non-uniform magnetic fields of the deflecting yoke.

Accordingly, with the electron gun assembly having the above arrangement, the two problems, i.e., an increase in diameter and improvement in resolving power degraded by deflection distortion, can be solved.

In the electron gun assembly having the above arrangement, however, since the focusing electrode G5 and final accelerating electrode G6 of the main lens do not have side wall portions (peripheral rims) along the surfaces of the electron beam holes, the diameter in the vertical direction is decreased compared to that in the horizontal direction. Accordingly, the spherical aberration in the vertical direction becomes very large as compared to that in the horizontal direction. The electron beam spot diameters in the vertical direction increase to be larger than the electron beam spot diameters in the horizontal direction. Then, the electron beam spot becomes vertically elongated at the central portion of the screen to degrade the resolving power there.

In particular, when the size and deflecting angle of the cathode ray tube are large, the function of the first quadrupole lens described above must be reinforced. In this case, the diameter in the vertical direction must be further decreased by, e.g., changing the true-circular holes formed in the focusing electrode G5 and final accelerating electrode G6 to horizontally elongated holes. As a result, the spherical aberration in the vertical direction further increases, and the electron beam spot becomes more vertically elongated at the central portion of the screen to considerably degrade the resolving power at the central portion of the screen.

As described above, in order to improve the resolving power of the cathode ray tube, the diameter of the main lens must be increased without increasing the gap among the three electron beams, and the over focus in the vertical direction on the peripheral portion of the screen must be reduced.

As an electron gun assembly that achieves increase in diameter of the main lens and improvement of the deflecting distortion, the following one is available. In this electron gun assembly, the main lens is constituted by a focusing electrode, an intermediate electrode to which a desired voltage is applied from a resistor incorporated in a tube, and a final accelerating electrode. An asymmetric focusing electric field having a relatively strong focusing function in the vertical direction is formed near the focusing electrode. An asymmetric divergent electric field having a relatively strong divergent function in the vertical direction is formed near the final accelerating electrode. The asymmetric focusing and divergent electric fields are substantially separated from each other by the intermediate electrode. A dynamic voltage that changes in synchronism with deflection of the electron beam is supplied to the focusing electrode.

With this structure alone, the spherical aberration in the vertical direction becomes very large compared to that in the horizontal direction, and the electron beam spot diameter in the vertical direction becomes larger than that in the horizontal direction. This forms a vertically elongated electron beam spot at the central portion of the screen, and lowers the resolving power at the central portion of the screen. In particular, when the size of a cathode ray thin tube or the deflecting angle is large, the spherical aberration in the vertical direction further increases to considerably degrade the resolving power.

BRIEF SUMMARY OF THE INVENTION

It is an object of the present invention to provide a color cathode ray tube having an electron gun assembly in which small, uniform beam spots are formed over the entire range of the phosphor screen to increase the resolving power of the cathode ray tube.

According to the present invention, there is provided a color cathode ray tube comprising an electron gun assembly and a resistor arranged in the tube near the electron gun assembly, the electron gun assembly having an electron beam generating portion for generating three electron beams lined up in line and composed of a center beam and a pair of side beams which travel on one horizontal plane, and a main lens for focusing the electron beams emitted from the electron beam generating portion finally on a phosphor screen, the main lens being constituted by a focusing electrode, at least one intermediate electrode, and a final accelerating electrode sequentially disposed from the electron beam generating portion side toward the phosphor screen, each of the focusing electrode, the intermediate electrode, and the final accelerating electrode being formed with three electron beam holes lined up in line to correspond to the three electron beams, wherein a high voltage to be supplied to the final accelerating electrode is divided by the resistor to supply a predetermined voltage to the intermediate electrode, so that voltages of the focusing electrode, the intermediate electrode, and the final accelerating electrode that constitute the main lens sequentially increase from the electron beam generating portion side toward the phosphor screen, and the electron beam holes, on the focusing electrode side, of the intermediate electrode adjacent to the focusing electrode, and the electron beam holes, on the final accelerating electrode side, of the intermediate electrode adjacent to the final accelerating electrode, form vertically elongated holes that are longer in a vertical direction than in a horizontal direction.

In the cathode ray tube, the electron beam holes in the focusing electrode on the intermediate electrode side, and the electron beam holes in the final accelerating electrode on the intermediate electrode side, form open holes not having side wall portions. The electron beam holes, on the focusing electrode side, of the intermediate electrode adjacent to the focusing electrode, and the electron beam holes, on the final accelerating electrode side, of the intermediate electrode adjacent to the final accelerating electrode, form vertically elongated holes that are longer in the vertical direction than in the horizontal direction.

In the electron gun assembly having the above structure, in the same manner as in the conventional electron gun assembly, a large-diameter extension electric field lens is formed by extending the main lens with the intermediate electrode. A focusing electric field having a stronger focusing function in the vertical direction than in the horizontal direction is formed between the fifth grid and the adjacent intermediate electrode. A divergent electric field having a stronger divergent function in the vertical direction than in the horizontal direction is formed between the sixth grid and the adjacent intermediate electrode. At the central portion of the screen, the extension and divergent electric fields balance with each other. At the peripheral portion of the screen, the electron lens between the fifth grid and the adjacent intermediate electrode is weakened to weak the focusing function in the vertical direction to compensate for overfocusing in the vertical direction effected by the non-uniform magnetic fields of the deflection yoke. In addition, when compared to the conventional electron gun assembly, the spherical aberration in the vertical direction can be improved without worsening the spherical aberration in the horizontal direction, so that the spherical aberration in the horizontal direction and that in the vertical direction can be alleviated and be made almost identical.

As a result, the electron beam spot diameters in the horizontal and vertical directions become almost equal to each other. Accordingly, very-small, almost true-circular electron beam spots can be obtained uniformly on the entire region of the screen. This can greatly improve the resolving power. Even when the size or deflecting angle of the cathode ray tube is increased, the quadrupole function can be enhanced without increasing the spherical aberration. Conventional distortion of the electron beam spot can be eliminated, and nearly circular electron beam spots can be obtained on the entire region of the screen.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An electron gun assembly according to an embodiment of the present invention will be described with reference to the accompanying drawings.

Figure 1A:
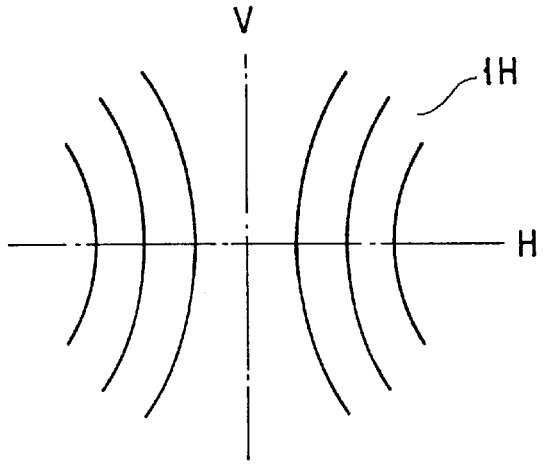
FIGS. 1A and 1B respectively show horizontal and vertical deflecting magnetic fields in a self convergence type cathode ray tube incorporating an inline type electron gun assembly.
Figure 1B:
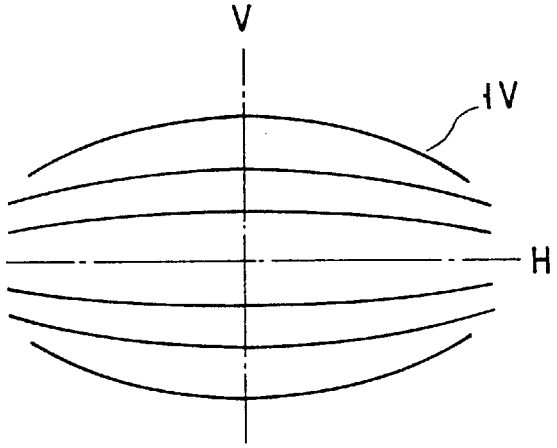
Figure 2:
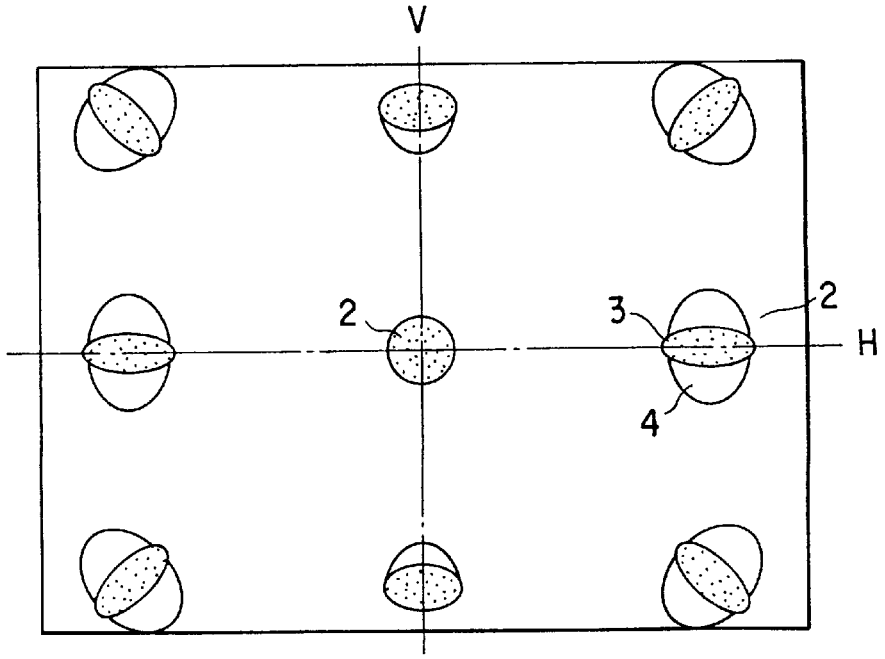
FIG. 2 is a plan view showing electron beam spots for explaining the deflection distortion of a conventional inline type color cathode ray tube.
Figure 3A:
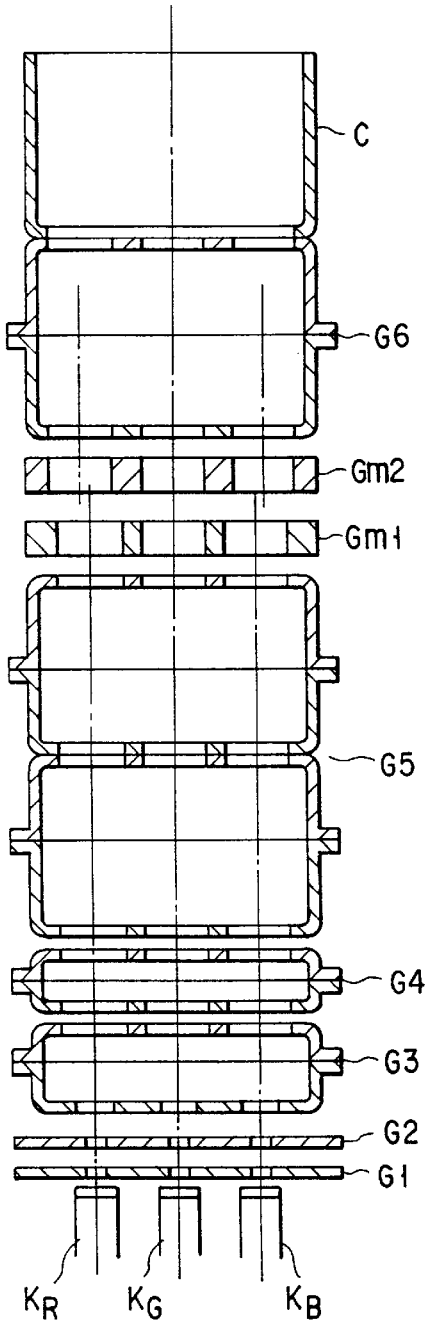
FIGS. 3A and 3B are sectional views schematically showing the horizontal and vertical structures, respectively, of an electron gun assembly incorporated in the conventional inline type color cathode ray tube.
Figure 3B:
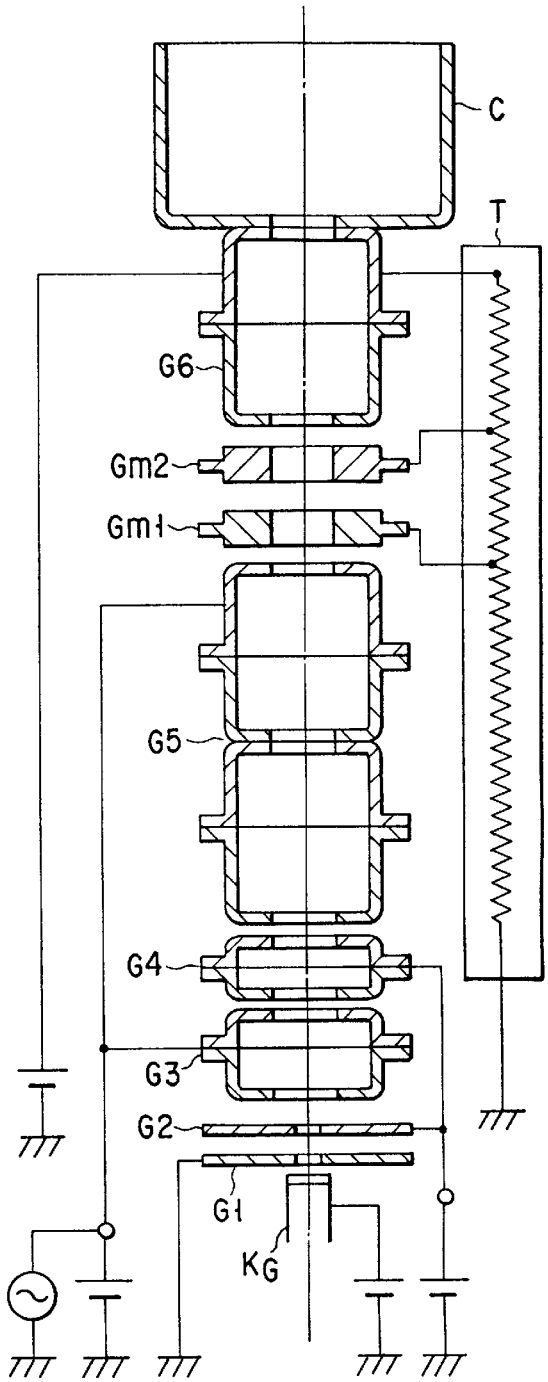
Figure 4:
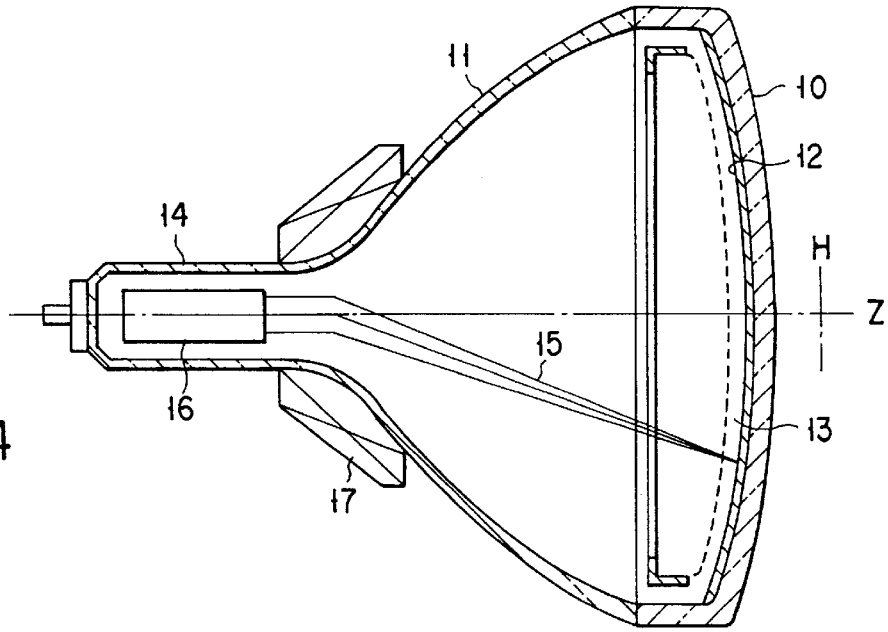
FIG. 4 is a sectional view schematically showing the structure of an inline type color cathode ray tube according to an embodiment of the present invention.

FIG. 4 shows an inline type color cathode ray tube according to this embodiment. This color cathode ray tube has an envelope constituted by a panel 10 and a funnel 11 integrally bonded to the panel 10. A phosphor screen 12 formed of a three-color striped phosphor layer for emitting blue, green, and red light is formed on the inner surface of the panel 10, i.e., the faceplate. A shadow mask 13 is arranged to oppose the phosphor screen 12. The shadow mask 13 is formed with a large number of electron beam holes through which electron beam pass. An electron gun assembly 16 is disposed in a neck 14 of the funnel 11. The electron gun assembly 16 emits three electron beams 15B, 15G, and 15R lined up in line, i.e., a center beam 15G and a pair of side beams 15B and 15R passing on one horizontal plane. The three electron beams 15B, 15G, and 15R emitted from the electron gun assembly 16 are deflected by a magnetic field generated by a deflecting yoke 17 mounted on the outer surface of the funnel 11, to scan the phosphor screen 12 in the horizontal (H) and vertical (V) directions, thereby displaying a color image on the phosphor screen 12.

Figure 5A:
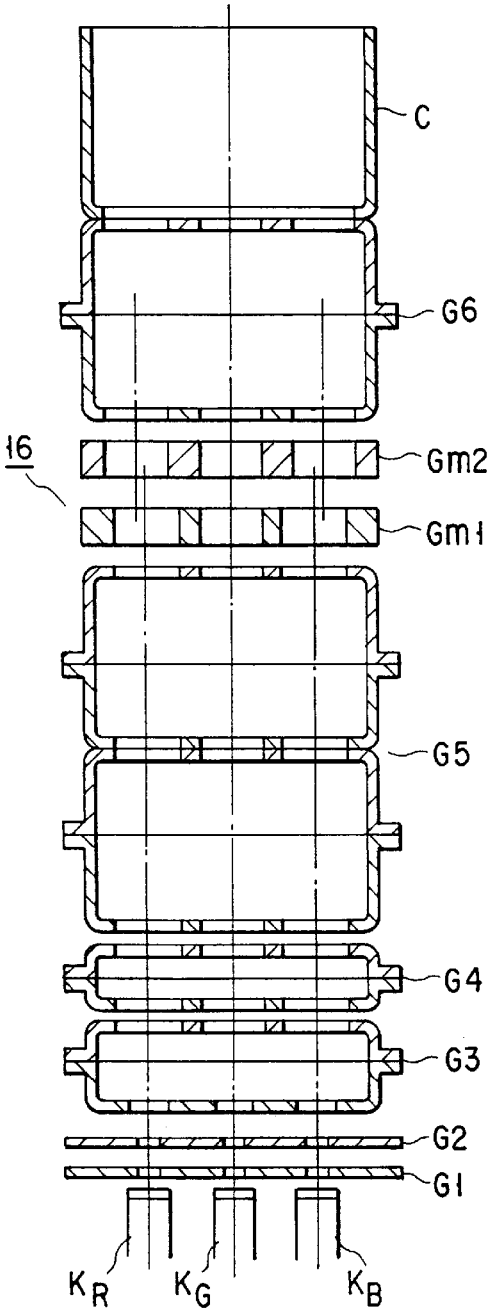
FIGS. 5A and 5B are sectional views schematically showing the horizontal and vertical structures, respectively, of an electron gun assembly incorporated in the inline type color cathode ray tube according to the embodiment of the present invention.
Figure 5B:
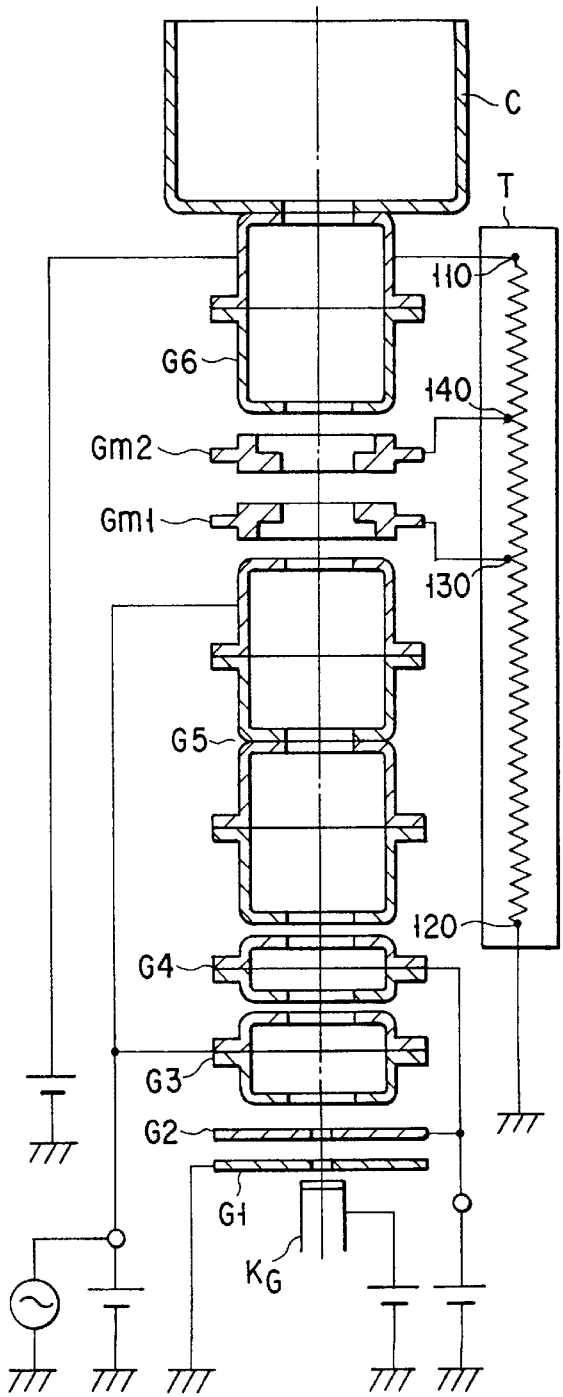

As shown in FIGS. 5A and 5B, this electron gun assembly 16 has three cathodes KB, KG, and KR lined up in line in the horizontal (H) direction, and three heaters (not shown) for heating the three cathodes KB, KG, and KR. First, second, third, fourth, and fifth grids G1, G2, G3, G4, and G5, intermediate electrodes Gm1 and Gm2, a sixth grid G6, and a convergence cup C are arranged in this order between the cathodes KB, KG, and KR and the phosphor screen 12. The first to sixth grids G1 to G6 are supported and fixed by insulating support rods (not shown), and the convergence cup C is mounted on the sixth grid G6.

A resistor T as shown in FIG. 5B is arranged near the electron gun assembly 16. One end 110 of the resistor T is connected to the sixth grid G6, the other end 120 thereof is grounded, and intermediate points 130 and 140 thereof are respectively connected to the first and second predetermined intermediate electrodes Gm1 and Gm2.

Figure 6:
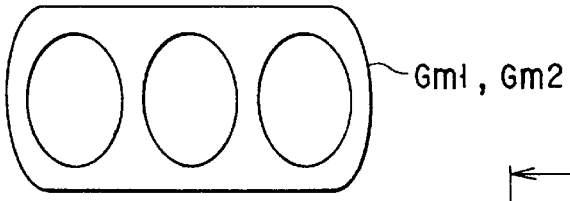
FIG. 6 is a front view showing the grids shown in FIGS. 5A and 5B.

Three electron beam holes aligned in the horizontal (H) direction and having predetermined sizes are formed in each grid. The first and second grids G1 and G2 are formed of thin plate electrodes. Three small-diameter circular electron beam holes are formed in each plate electrode. Each of the third, fourth, fifth, and sixth grids G3, G4, G5, and G6 is formed by abutting the free ends of a plurality of cup-like electrodes. Three circular electron beam holes having diameters slightly larger than those of the electron beam holes formed in the second grid G2 are formed in the third grid G3 on the second grid G2 side. Three large-diameter circular electron beam holes are formed in each of the third grid G3 on the fourth grid G4 side, the two sides of the fourth grid G4, the two sides of the fifth grid G5, and the two sides of the sixth grid G6. In particular, the fifth grid G5 on the first intermediate electrode Gm1 side and the sixth grid G6 on the second intermediate electrode Gm2 side are determined to have open holes not formed with side wall surfaces along the surfaces of the electron beam holes, i.e., not formed with peripheral rims. Each of the first and second intermediate electrodes Gm1 and Gm2 is obtained by forming three large-diameter electron beam holes in a thick electrode plate. The electron beam holes, on the fifth grid G5 side, of the first intermediate electrode Gm1 adjacent to the fifth grid G5, and the electron beam holes, on the sixth grid G6 side, of the second intermediate electrode Gm2 adjacent to the sixth grid G6, are formed as vertically elongated holes the diameter of which in the vertical direction is larger than that in the horizontal direction, as shown in FIG. 6. The electron beam holes, on the second intermediate electrode Gm2 side, of the first intermediate electrode Gm1 adjacent to the fifth grid G5, and the electron beam holes, on the first intermediate electrode Gm1 side, of the second intermediate electrode Gm2 adjacent to the sixth grid G6 are true-circular holes.

The electron beam holes in the horizontal (H) and vertical (V ) directions will be described.

Figure 7:
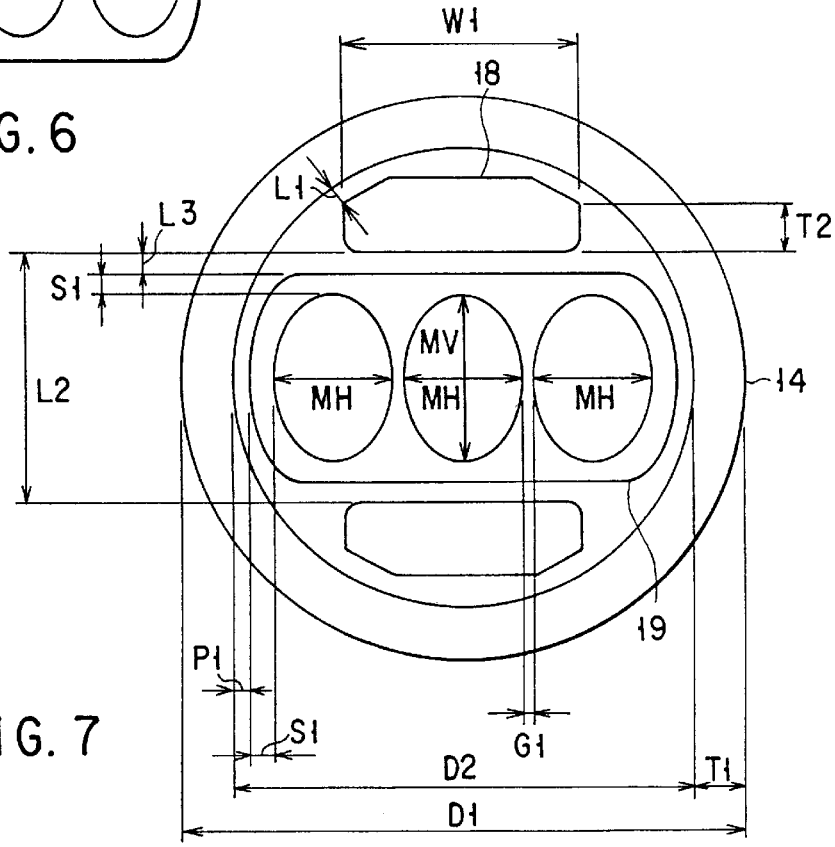
FIG. 7 is a sectional view schematically showing the positional relationship between the neck and electron gun assembly in the inline color cathode ray tube according to the present invention.

To improve the electron beam spot diameter, it is effective to increase the electron beam holes of the electrodes that form the main lens of the electron gun assembly, thus decreasing spherical aberration, as described above. The diameters of the electron beam holes of the electrodes that form the main lens are limited by the inner diameter of the neck 14 where the electron gun assembly is arranged. Accordingly, the maximum electron beam transmitting hole diameter of the electrodes is determined by the neck diameter. FIG. 7 shows the positional relationship between the neck 14 and electron gun assembly 16. Assume that an outer diameter D1 of the neck 14 is 29.1 mm and that a thickness T1 of the neck 14 is 2.6 mm. From the withstand voltage characteristics, a gap P1 between the inner surface of the neck 14 and an electrode 19 must be 1 mm. To maintain the strength of the electrode 19, a distance S1 between the electron beam transmitting hole end of the electrode 19 and the end of the electrode 19 must be 1 mm, and each electron beam transmitting hole gap G1 of the electrode 19 must be 0.4 mm. Hence, a maximum electron beam transmitting hole diameter MH in the horizontal direction is about 6.3 mm. Concerning the vertical direction, assume that a minimum thickness T2 of each insulating support rod 18 is 2.8 mm, and that a width W1 thereof is 12 mm. Similarly to that described above, from the withstand voltage characteristics, a minimum gap L1 between the neck 14 and insulating support rod 18 must be 1 mm. Accordingly, a gap L2 between the insulating support rods 18 is approximately 13 mm. Similarly, from the withstand voltage characteristics, a gap L3 between the electrode 19 and insulating support rod 18 must be 1 mm. Hence, a maximum electron beam transmitting hole diameter MV in the vertical direction is about 9 mm.

More specifically, when the respective electron beam holes are simply increased to a maximum, the electron beam transmitting hole diameters in the vertical direction can be made larger than those in the horizontal direction. If such electron beam holes are formed, large astigmatism is generated between the horizontal and vertical directions. Therefore, the electron beam holes are generally formed as circular holes having a diameter close to the maximum electron beam transmitting hole diameter MH in the horizontal direction. When, however, non-circular electron beam holes are to be formed in order to generate an asymmetric electric field, the larger the electron beam holes, the smaller the spherical aberration can be. Accordingly, if the electron beam transmitting hole diameter in the horizontal direction is left unchanged at the limit while the electron beam transmitting hole diameter in the vertical direction is set large with an extra margin to form vertically elongated holes, the spherical aberration can be decreased. In the electron gun assembly according to the embodiment of the present invention, the vertically elongated electron beam holes formed in the first intermediate electrode Gm1 on the fifth grid G5 side and in the second intermediate electrode Gm2 on the grid G6 side can decrease the spherical aberration.

During operation, a DC voltage of about 100V to 200V and a modulation signal corresponding to the image are applied to each of the cathodes KR, KG, and KB of the electron gun assembly. The first grid G1 is grounded, and a voltage of about 500V to 1,000V is applied to the second grid G2. The cathodes KR, KG, and KB, and the first and second grids G1 and G2 form a triode portion, and electron beams emitted from the triode portion form a crossover.

The third and fifth grids G3 and G5 are connected to each other in the tube. A focusing voltage obtained by superposing a parabolic dynamic voltage, which changes in synchronism with deflection of the electron beam, to a constant DC voltage of about 6 kV to 10 kV is applied to the third and fifth grids G3 and G5. The fourth and second grids G4 and G2 are connected to each other in the tube. The third, fourth, and fifth grids G3, G4, and G5 form an auxiliary lens to preliminarily focus the electron beams.

A final acceleration voltage of about 25 kV to 35 kV is applied to the sixth grid G6. A voltage about 40% the final acceleration voltage is supplied to the first intermediate electrode Gm1 from the resistor T. Similarly, a voltage about 65% the final acceleration voltage is supplied to the second intermediate electrode Gm2 from the resistor T. The fifth grid G5, first and second intermediate electrodes Gm1 and Gm2, and sixth grid G6 form the main lens to finally focus the electron beams onto the screen. In this manner, when the range of the main lens is extended by the first and second intermediate electrodes Gm1 and Gm2 as described above to smoothly increase the potential from the fifth grid G5 to the sixth grid G6, a large-diameter extension electric field lens is formed. This large-diameter extension electric field lens can decrease the electron beam spot.

According to this electron gun assembly, different from the conventional electron gun assembly, uniform electron beam spots can be obtained throughout the entire range of the screen, and the main lens has a larger diameter than that of the conventional electron gun assembly. Regarding this, the behavior of the electron beams upon traversing the main lens portion of the electron gun assembly will be described in detail separately in the horizontal (H) and vertical (V) directions.

In the fifth grid G5, each electron beam transmitting hole is formed with no peripheral rim (wall surface portion along the transmitting hole). In the horizontal (H) direction, an equipotential line common for the three electron beam holes and having a small radius of curvature is formed. In the vertical (V) direction, an equipotential line having a larger radius of curvature than in the horizontal (H) direction is formed. A focusing electric field having a stronger focusing function in the vertical (V) direction than in the horizontal (H) direction is thus formed. Spherical aberration in the horizontal (H) direction becomes smaller (better) than that obtained when the electron beam holes are true-circular holes. Spherical aberration in the vertical direction becomes equal to that obtained when the electron beam holes are true-circular holes.

In the first intermediate electrode Gm1 on the fifth grid G5 side, the respective electron beam holes are formed with wall surface portions along them, and vertically elongated electron beam holes having a diameter larger in the vertical (V) direction than in the horizontal (H) direction are formed. Accordingly, in the vertical (V) direction, an equipotential line having a smaller radius of curvature than in the horizontal (H) direction is formed. Hence, a divergent electric field having a divergent function weaker in the vertical (V) than in the horizontal (H) direction is formed. Spherical aberration in the vertical (V) direction becomes smaller than that obtained when the electron beam holes are true-circular holes. Spherical aberration in the horizontal (H) direction becomes equal to that obtained when the electron beam holes are true-circular holes.

Therefore, between the fifth grid G5 and first intermediate electrode Gm1, a focusing electric field having a focusing function stronger in the vertical (V) direction than in the horizontal (H) direction is formed. Spherical aberration becomes almost equal in the horizontal and vertical directions, and is smaller than that obtained when the electron beam holes are true-circular holes. Similarly, between the sixth grid G6 and second intermediate electrode Gm2, a divergent electric field stronger in the vertical (V) direction than in the horizontal (H) direction is formed. Spherical aberration becomes almost equal in the horizontal and vertical directions, and is smaller than that obtained when the electron beam holes are true-circular holes.

Therefore, at the central portion of the screen, the focusing and divergent electric fields balance with each other. The electron beam is focused onto the same position without causing astigmatism between the horizontal (H) and vertical (V) directions. Since the spherical aberration in the horizontal (H) direction and that in the vertical (V) direction become essentially identical, the electron beam spot diameters become essentially equal between the horizontal (H) and vertical (V) directions. The spherical aberration in the horizontal (H) direction and that in the vertical (V) direction both become smaller than those obtained when the electron beam holes are true-circular holes. Hence, the electron beam spot size can be decreased. In other words, in this electron gun assembly, unlike in the conventional case, a true-circular electron beam spot can be formed, and its diameter can be further decreased than in the conventional case.

When the electron beam is deflected toward the peripheral portion of the screen, the focusing voltage becomes higher than a predetermined value since a dynamic voltage is applied it, thus becoming close to the voltage applied to the first intermediate electrode Gm1. The electron lens formed between the fifth grid G5 and the first intermediate electrode Gm1 adjacent to it is weakened to weak the focusing function in the vertical (V) direction. Meanwhile, the electron lens formed between the sixth grid G6 and the second intermediate electrode Gm2 adjacent to it does not change. In the main lens as a whole, the focusing function in the vertical (V) direction is weakened, so that over-focusing in the vertical (V) direction effected by the nonuniform magnetic fields of the deflection yoke can be compensated for. As a result, deflection distortion of the electron beam spots on the peripheral portion of the screen is eliminated to form true-circular electron beam spots.

In fine, according to this electron gun assembly, the electron beam does not generate astigmatism between the horizontal (H) and vertical (V) directions, and the spherical aberration in the horizontal (H) direction and that in the vertical (V) direction can be made small and almost equal to each other. Thus, very-small, substantially true-circular electron beam spots can be obtained uniformly on the entire range of the screen, so that the resolving power can be improved greatly.

Even when the size or deflecting angle of the cathode ray tube increases, in this electron gun assembly, in order to enhance the function of the quadrupole formed between the fifth grid G5 and the first intermediate electrode Gm1 adjacent to it, for example, the circular electron beam holes in the fifth grid G5 on the first intermediate electrode Gm1 side are formed horizontally elongated, while the vertically elongated electron beam holes in the first intermediate electrode Gm1 on the fifth grid G5 side are formed vertically more elongated, so that the function of the quadrupole can be enhanced without degrading the spherical aberration. As a result, conventional distortion in the electron beam spots is eliminated, and almost circular electron beam spots can be obtained.

In the above embodiment, a quadra-potential electron gun assembly has been described. The present invention can similarly be applied to other electron gun assemblies such as bipotential and unipotential electron gun assemblies.

As described above, according to the present invention, a color cathode ray tube apparatus has an electron gun assembly and a resistor provided in the tube near the electron gun assembly. The electron gun assembly has an electron beam generating portion for generating three electron beams lined up in line, and a main lens for focusing the electron beams emitted from the electron beam generating portion finally on a phosphor screen. A main lens is constituted by a focusing electrode, an intermediate electrode, and a final accelerating electrode sequentially disposed from the electron beam generating portion side toward the phosphor screen. Each of the focusing electrode, the intermediate electrode, and the final accelerating electrode is formed with three electron beam holes lined up in line to correspond to the three electron beams. The resistor divides a high voltage to be supplied to the final accelerating electrode, thereby supplying a predetermined voltage to the intermediate electrode. The voltages of the focusing electrode, the intermediate electrode, and the final accelerating electrode that constitute the main lens sequentially increases from the electron beam generating portion side toward the phosphor screen. The electron beam holes in the focusing electrode on the intermediate electrode side, and the electron beam holes in the final accelerating electrode on the intermediate electrode side, form open holes not formed with side wall portions. The electron beam holes, on the focusing electrode side, of the intermediate electrode adjacent to the focusing electrode, and the electron beam holes, on the final accelerating electrode side, of the intermediate electrode adjacent to the final accelerating electrode, form vertically elongated holes that are longer in the vertical direction than in the horizontal direction. Then, in the same manner as in the conventional electron gun assembly, a large-diameter extension electric field lens is formed by extending the main lens with the intermediate electrode. A focusing electric field having a stronger focusing function in the vertical direction than in the horizontal direction is formed between the fifth grid and the adjacent intermediate electrode. A divergent electric field having a stronger divergent function in the vertical direction than in the horizontal direction is formed between the sixth grid and the adjacent intermediate electrode. At the central portion of the screen, the extension and divergent electric fields balance with each other. At the peripheral portion of the screen, the electron lens between the fifth grid and the adjacent intermediate electrode is weakened to weak the focusing function in the vertical direction to compensate for over-focusing in the vertical direction effected by the nonuniform magnetic fields of the deflection yoke. In addition, when compared to the conventional electron gun assembly, the spherical aberration in the vertical direction can be improved without degrading the spherical aberration in the horizontal direction, so that the spherical aberration in the horizontal direction and that in the vertical direction can be improved and be made almost identical. As a result, the electron beam spot diameters in the horizontal and vertical directions become nearly equal to each other. Accordingly, very-small, essentially true-circular electron beam spots can be obtained uniformly on the entire region of the screen. This can greatly improve the resolving power. Even when the size or deflecting angle of the cathode ray tube is increased, the quadrupole function can be enhanced without increasing the spherical aberration. Conventional distortion of the electron beam spot can be eliminated, and nearly circular electron beam spots can be obtained on the entire region of the screen.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode ray tube apparatus comprising:

an envelope having a faceplate formed with a phosphor screen, and an electron gun assembly having an electron beam generating portion for generating three electron beams lined up in line and composed of a center beam and a pair of side beams transmitted on one horizontal plane, and a main lens for focusing the electron beams emitted from said electron beam generating portion finally on said phosphor screen, said main lens being constituted by a focusing electrode, at least one intermediate electrode, and a final accelerating electrode sequentially disposed from said electron beam generating portion side toward said phosphor screen, each of said focusing electrode, said intermediate electrode, and said final accelerating electrode being formed with three electron beam holes lined up in line to correspond to the three electron beams, wherein a high voltage to be supplied to said final accelerating electrode is divided by a resistor to supply a predetermined voltage to said intermediate electrode, so that voltages of said focusing electrode, said intermediate electrode, and said final accelerating electrode that constitute said main lens sequentially increase from said electron beam generating portion side toward said phosphor screen, and said electron beam holes, on said focusing electrode side, of said intermediate electrode adjacent to said focusing electrode, and said electron beam holes, on said final accelerating electrode side, of said intermediate electrode adjacent to said final accelerating electrode, form vertically elongated holes that are longer in a vertical direction than in a horizontal direction, said resistor being arranged in a tube near said electron gun assembly.

2. An apparatus according to claim 1, wherein the focusing voltage to be supplied to said focusing electrode changes in synchronism with deflection of the electron beams.

* * * * *